US005173712A

United States Patent [19]

Murakami et al.

[11] Patent Number: 5,173,712

[45] Date of Patent: Dec. 22, 1992

[54] ROD ANTENNA WITH FILTER ARRANGEMENT

[75] Inventors: Yuichi Murakami, Kanagawa; Kiyokazu Ieda, Tokyo; Tomio Yasuda, Saitama, all of Japan

[73] Assignee: Aisin Seiki K.K., Kariya, Japan

[21] Appl. No.: 375,304

[22] Filed: Jun. 19, 1989

[30] Foreign Application Priority Data

| | | | |
|---|---|---|---|
| Jun. 17, 1988 | [JP] | Japan | 63-150459 |
| Jul. 29, 1988 | [JP] | Japan | 63-191952 |
| Jul. 29, 1988 | [JP] | Japan | 63-191953 |

[51] Int. Cl.[5] ..... H01Q 1/100; H01Q 1/500

[52] U.S. Cl. ..... 343/715; 343/850; 343/901

[58] Field of Search ..... 343/713, 715, 900, 901, 343/850, 852

[56] References Cited

U.S. PATENT DOCUMENTS

| | | | |
|---|---|---|---|
| 4,163,195 | 7/1979 | Sauer | 343/713 |
| 4,200,874 | 4/1980 | Harada | 343/749 |
| 4,734,703 | 3/1988 | Nakase et al. | 343/715 |
| 4,748,450 | 5/1988 | Hines et al. | 343/715 |
| 4,850,034 | 7/1989 | Campbell | 343/715 |
| 4,945,361 | 7/1990 | Egashira | 343/715 |
| 5,072,230 | 12/1991 | Taniyoshi et al. | 343/715 |

FOREIGN PATENT DOCUMENTS

| | | | |
|---|---|---|---|
| 0027507 | 3/1981 | Japan | 343/713 |
| 0023603 | 2/1984 | Japan | 343/900 |
| 0030305 | 2/1984 | Japan | 343/901 |
| 0030306 | 2/1984 | Japan | 343/715 |
| 0042507 | 2/1988 | Japan . | |
| 0121323 | 5/1988 | Japan | 455/293 |

*Primary Examiner*—Rolf Hille
*Assistant Examiner*—Peter Toby Brown
*Attorney, Agent, or Firm*—Sughrue, Mion, Zinn, Macpeak & Seas

[57] ABSTRACT

A rod antenna includes extensible elements electrically connected to a high frequency power supply member. A low pass filter has one terminal connected to the extensible elements and the other terminal connected to a low frequency power supply member.

1 Claim, 6 Drawing Sheets

ROD ANTENNA WITH FILTER ARRANGEMENT

BACKGROUND OF THE INVENTION

1. Field Of The Invention

The present invention relates to a rod antenna and especially relates to a rod antenna which can receive AM and FM signals and can send signals in VHF and UHF bands. The present invention can be used for AM or FM radio, TV or any other radio communications, for example, MCA (Multi Channel Access) radio, wireless telephone, CB radio, Amateur radio and the like. The radios use AM, FM, VHF or UHF bands. Also, the present invention is used as a rod antenna for automobiles.

2. Description of the Prior Art

There are extendible and retractable antennas which can be stored in an automobile when the antenna is not used. For example, Japanese Kokai 59(1984)-30305 shows such a rod antenna. FIGS. 1 and 2 of Japanese Kokai 59(1984)-30305 show the elements 1*a*, 1*b*, . . . 1*i* of the rod antenna. FIG. 2 of the Kokai '305 corresponds to FIG. 9 of the present application. The lowest element 1*a* of the rod antenna is connected to the metallic base element 3 through an insulating material 2. The base element 3 is connected to the body 5 of an automobile by the fitting 4. The lowest element 1*a* is contacted by a spring 8 connected to the internal conductor 7 of the coaxial connector 6. The lowest portion 9 of the lowest element 1*a* is a stopper which prevents the element 1*a* from pulling out. The element 1*i* is connected to the flexible wire 10 which extends the elements of the rod antenna. In this type of rod antenna, there is a high electrostatic capacity between the lowest element 1*a* and the base element 3 because these two are close to each other. FIG. 3 of Japanese Kokai 59(1984)-30305 shows a high electrostatic capacity C between the antenna element and the ground. Although this type of antenna works well in a low frequency band such as AM or FM bands, this type of antenna may not work in high frequency bands such as VHF or UHF if the length of the antenna is adjusted because of the high electrostatic capacity. Therefore, in Japanese Kokai 59(1984)-30305, the lowest element of the rod is divided into two parts so that the antenna can work in a higher frequency band such as VHF or UHF. FIGS. 4 and 5 of Japanese Kokai 59(1984)-30305 show that the extensible lower element is divided into two parts 14*a*1 and 14*a*2. FIG. 5 of the Kokai '305 corresponds to FIG. 10 of the present application. Upper element 14*a*1 and bottom element 14*a*2 are connected through the center insulating material 15. A coaxial cable is inserted into bottom element 14*a*2. The center conductor 21 is connected to the upper element 14*a*1 and the external conductor 22 is connected to the bottom element 14*a*2. In accordance with this arrangement, the distance between the upper portion of the upper element 14*a*1 of the rod antenna and the ground is larger. Therefore the capacity is lower so the antenna can be used in a high frequency band.

However, when a rod antenna is connected to both an AM/FM band receiver and a VHF/UHF band transmitter in order to receive an AM/FM band signal and to send a VHF/UHF band signal, it is difficult to match impedances between the AM/FM band signal and the VHF/UHF band signal. Furthermore, if the power of the VHF/UHF band transmitter is relatively high, the AM/FM band receiver may be broken. Therefore, for example, when both an AM/FM radio and a VHF/UHF band transmitter are used in an automobile, separate antennas for each frequency band are required or a branching filter for separating the frequency signals is required.

Further, when a rod antenna is used for both an AM/FM band and a VHF/UHF band, an AM/FM power supply member may affect the high frequency band characteristics because the circuit for a high frequency band is very sensitive to its construction.

Japanese Kokai 61(1986)-46601 shows a first antenna connected to the coaxial cable for the first frequency band and a second antenna is made by using the external conductor of the coaxial cable and the body of an automobile for the second frequency band. However, this requires separate antennas for each frequency band. When an AM/FM band and a VHF/UHF band are used in one antenna, it is required for matching the AM/FM band and the VHF/UHF band to use a branching filter or a separator. In this way, as shown in FIG. 7, the frequency band width is relatively narrow. In FIG. 7, the graph shows the characteristics of a monopole antenna as to frequency vs SWR (Standing Wave Ratio). If SWR is under 2, an antenna is practical to use. In FIG. 7, a practical frequency band width is from about 905 to 955 MHz. For example, a mobile telephone has different frequencies for receiving and transmitting and there should be a certain distance between a received frequency band and a transmitted frequency. If a transmitted frequency band is set at 930 MHz, SWR for a received frequency is over 2. Therefore, it is difficult to receive a signal. In a conventional antenna, it is difficult to have a wide frequency bandwidth if an antenna is used for both AM/FM band and VHF/UHF band.

SUMMARY OF THE INVENTION

Accordingly, one of the objects of the present invention is to produce a rod antenna to obviate the above drawbacks.

Another object of the present invention is to produce a rod antenna which works in higher frequencies such as VHF or UHF as well as lower frequencies such as AM or FM bands without a branching filter or separator.

A further object of the present invention is to produce a rod antenna which has better high frequency band characteristics by reducing the influence of a low frequency band power supply member on a high frequency band power supply member.

Yet another object of the present invention is to produce a rod antenna which has a wide VHF/UHF bandwidth.

To achieve the above objects, and in accordance with the principles of the invention as embodied and broadly described herein, a rod antenna comprises extensible elements insulatedly placed in a grounded, body, a high frequency power supply member electrically connected to the element, a low pass filter having one terminal connected to the elements and a low frequency power supply member connected to the other terminal of the low pass filter. Further, the low pass filter comprises a coil having one terminal connected to the elements electrically and the other terminal connected to the low frequency power supply member, a first condenser connected between said one terminal of the coil and the ground, a second condenser connected between the other terminal of the coil and the ground, and a conductive power supply case connected to the body which stores the elements, the high frequency power supply member, the low pass filter and the low frequency power supply member, so that the capacity of the first condenser is reduced by using the electrostatic capacity between the power supply case and the elements.

In accordance with the above mentioned rod antenna of the present invention, electromagnetic waves received by the elements are sent to the high frequency power supply member directly and low frequency electromagnetic waves are sent to the low frequency power supply member through the low pass filter. When high frequency electromagnetic waves are applied to the high frequency power supply member, the elements send high frequency electromagnetic waves into the air, however, these high frequency electromagnetic waves are cut by the low pass filter so that the high frequency electromagnetic waves are not applied to the low frequency power supply member.

By using the electrostatic capacity between the power supply case and the elements, the capacity of the first condenser can be reduced, so the first condenser can be reduced in size and in cost.

Further, to achieve the above objects, and in accordance with the principles of the invention as embodied and broadly described herein, a rod antenna comprises extensible elements insulatedly placed in a grounded body, a high frequency power supply member electrically connected to the elements, a low pass filter having one terminal connected to the elements, a low frequency power supply member connected to the other terminal of the low pass filter, a coaxial cable having a center conductor which connects the low frequency power supply member and the low pass filter, wherein the center conductor of the coaxial cable is extended to the lowest part of the elements through a conductive spacer.

In accordance with the above mentioned rod antenna of the present invention, the elements, the conductive spacer and the center conductor of the coaxial cable constitute a condenser, so the electric potential between the elements and the center conductor is the same potential. Thus the center conductor comprises a part of the antenna together with the elements when the antenna is in high frequency bands. The matching for the antenna as a high frequency band antenna is good.

To achieve the above objects, and in accordance with the principles of the invention as embodied and broadly described herein, a rod antenna comprises extensible elements insulatedly placed in a grounded body, a high frequency power supply member electrically connected to the elements, a low pass filter having one terminal connected to the elements, a low frequency power supply member connected to the other terminal of the low pass filter, a coaxial cable connected to the high frequency power supply member, and a condenser placed along with the center conductor of the coaxial cable.

In accordance with the above mentioned rod antenna of the present invention, the inductance of the elements and the center conductor of the coaxial cable and the capacity of the condenser makes a series resonance circuit. The series resonance circuit makes SWR lower as shown in FIG. 8.

Further, in accordance with the above mentioned rod antenna of the present invention, when the extensible elements are extended, the extensible elements are over wrapped by the insulating part of the base element. Therefore, the electrostatic capacity between the extensible elements and the ground becomes lower. Furthermore, because the extensible elements can be made of same material, the extensible elements are strengthened. Since the base elements have less restrictions in size, the thickness of the base elements can be thicker than the extensible elements so that the base elements are strengthened as well.

BRIEF DESCRIPTION OF THE DRAWINGS

For a full understanding of the true scope of the invention, the following detailed description should be read in conjunction with the drawings, wherein.

DETAILED DESCRIPTION OF THE PREFERRED EMBODIMENTS

In the following, preferred embodiments of the present invention will be described with reference to the drawings.

Figure 1:
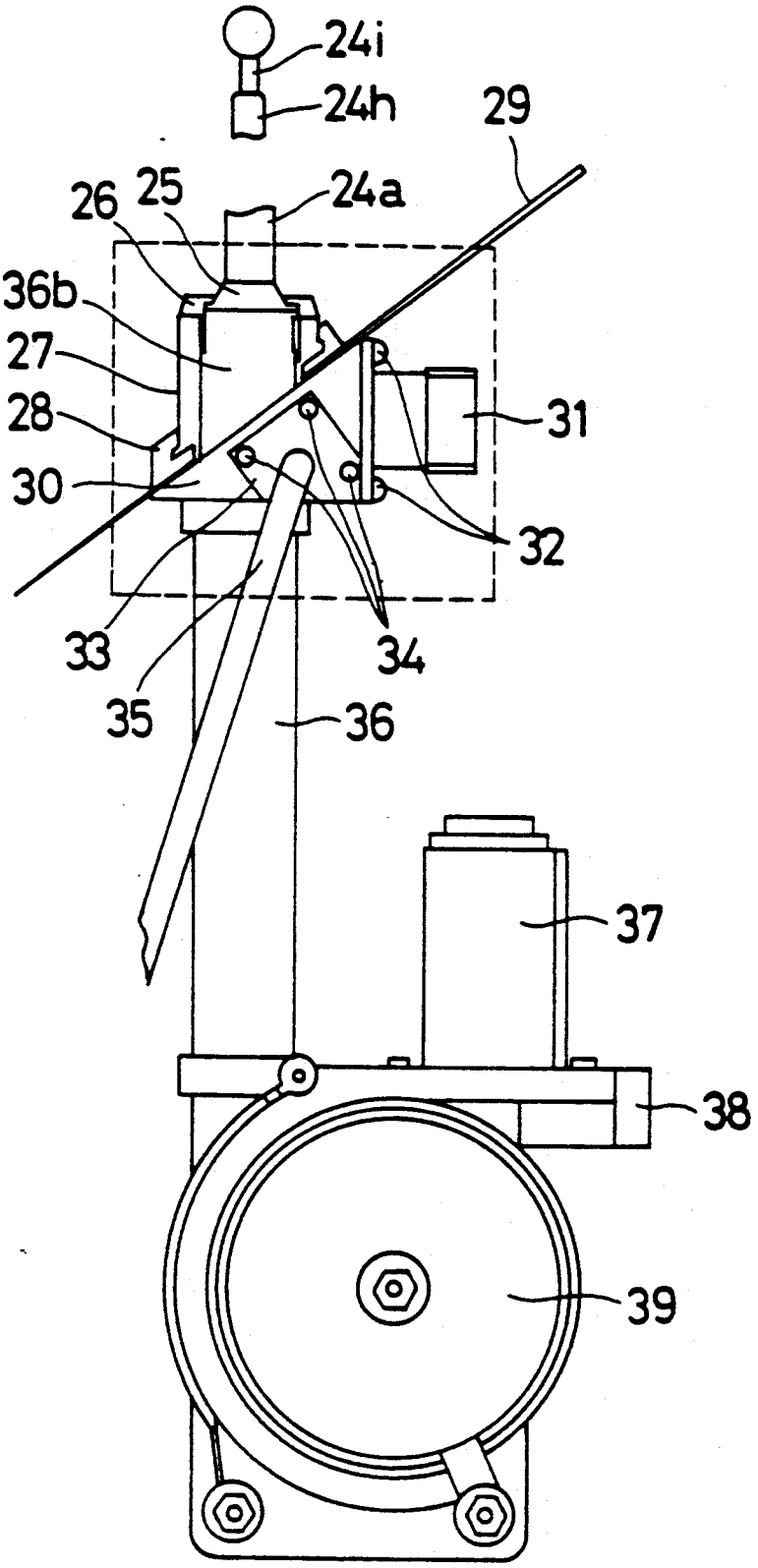
FIG. 1 is a front view showing one embodiment of the present invention.
Figure 2:
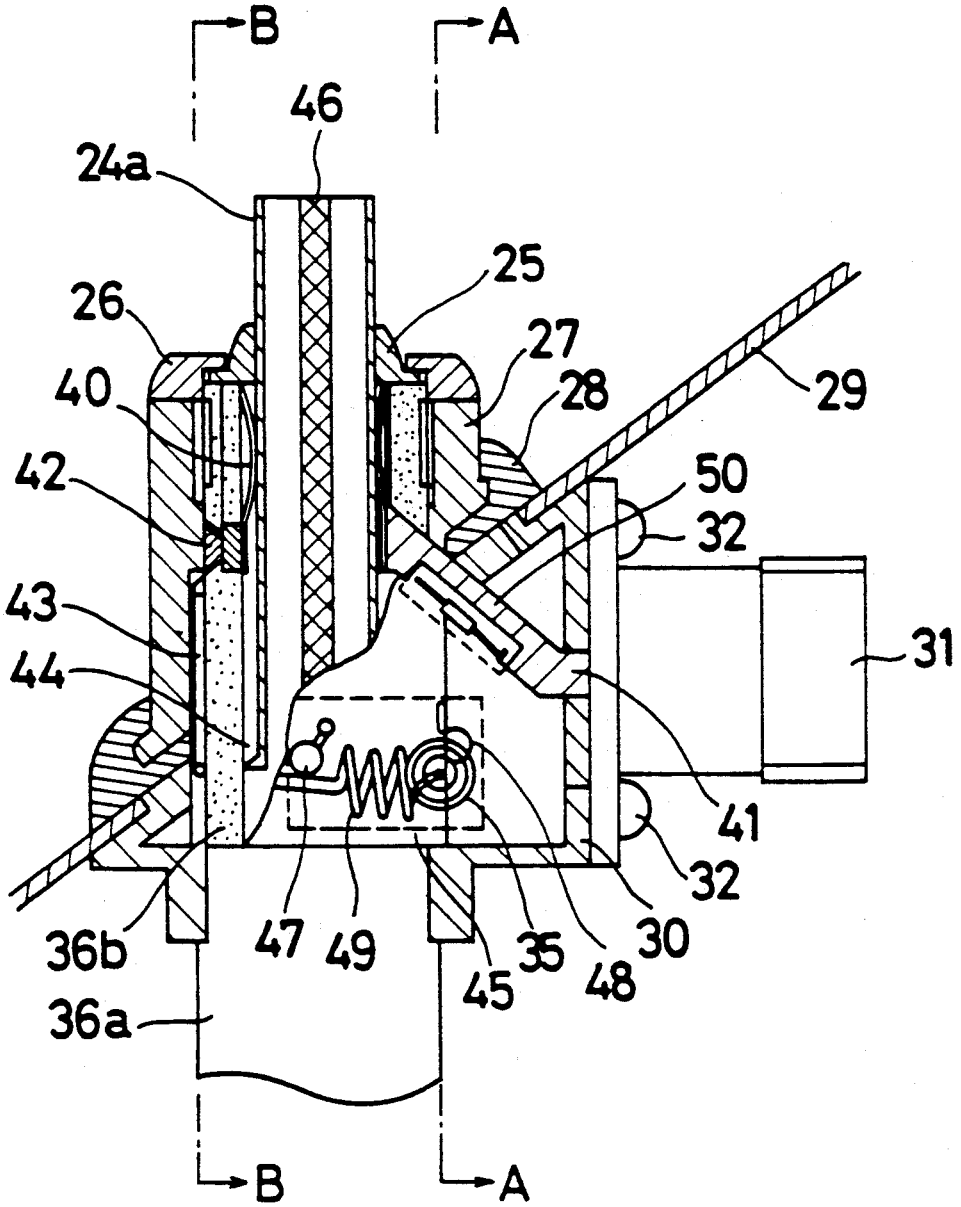
FIG. 2 is a cross-sectional view of a portion of FIG. 1 of the present invention.

Referring to FIGS. 1 and 2, elements 24*a*, . . . 24*h*, 24*i* are telescopically extensible. The lower element 24*a* of the extensible elements is connected with base elements 36*a*, 36*b* by a base cap 25 and a stopper 44. The base element 36*a* is made of metallic conducting material and the base element 36*b* is made of insulating material. The base element 36*a* and the stopper 44 are made in cylindrical form. The stopper 44 is connected inside the base element 36*b* and the extensible element 24*a* is placed inside the stopper 44 so the extensible element 24 is able to extend. The extensible element 24*a* has a flange portion at the bottom of the element 24*a*, so that the base element 36*a* is fixed to a body 29 by a fitting 26 made of synthetic resin through a metallic power supply case 30, water proof cap 28 and an element adaptor 27. Thus the body 29 is connected with the power supply case 30 and the base element 36*a*, electrically.

Figure 5:
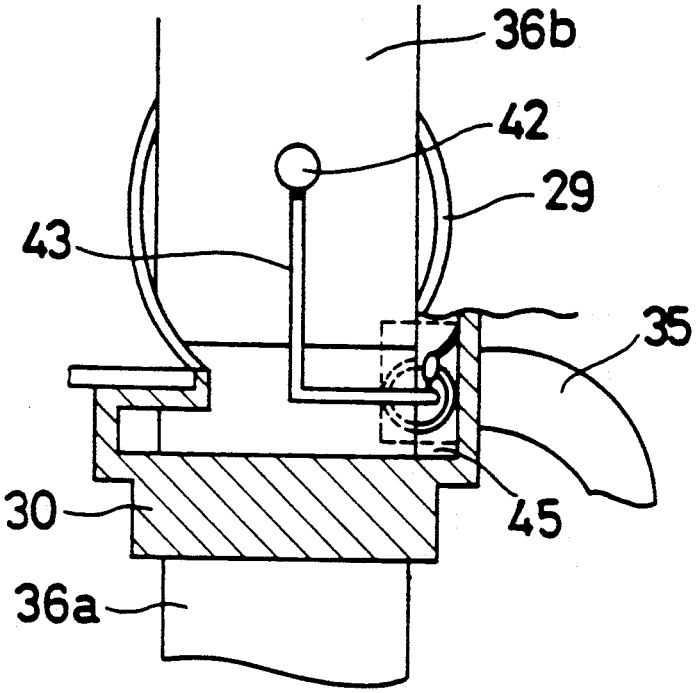
FIG. 5 is a cross-sectional view of FIG. 2 along the line B—B.
Figure 6:
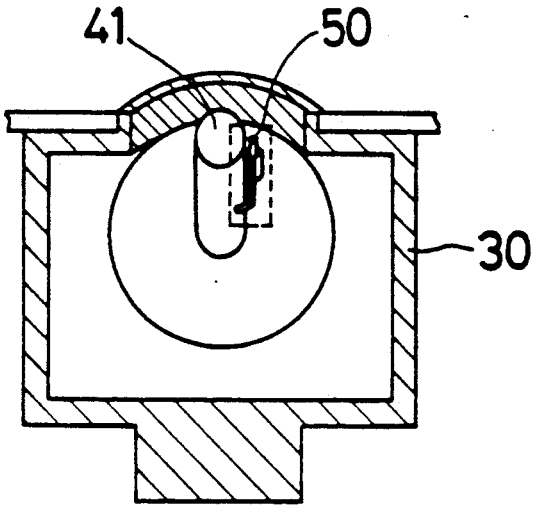
FIG. 6 is a cross-sectional view of FIG. 2 along the line A—A.
Figure 7:
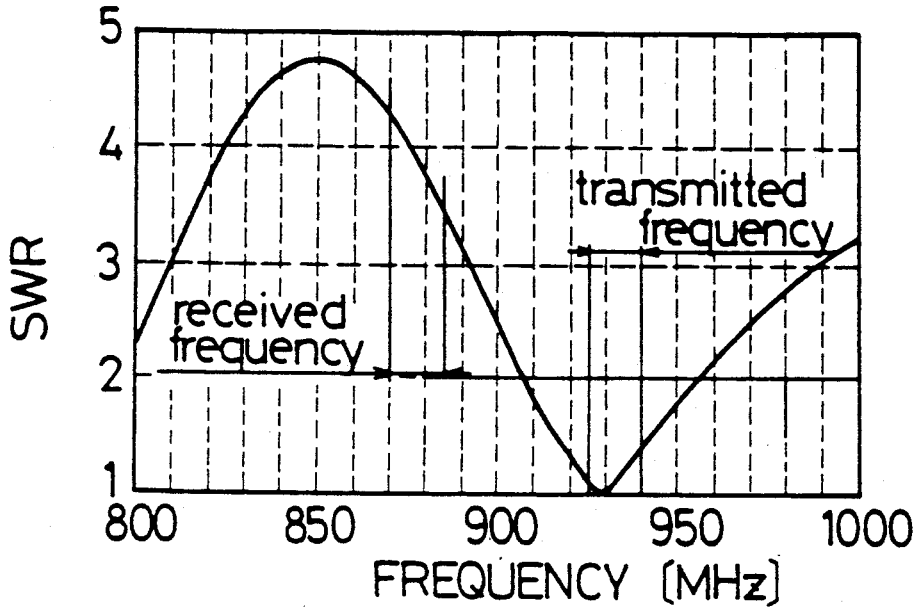
FIG. 7 is a graph showing the SWR characteristics of conventional mono pole antenna.

As shown in FIGS. 2 and 5, a power supply point 42 for AM/FM signals is connected to a contacting spring 40 and a center conductor 43 of AM/FM coaxial cable 35 through a low pass filter 45. The center conductor 43 of the AM/FM coaxial cable 35 is connected to the low pass filter 45 along with the base element 36*b*. The base element 36*b* is a spacer between the extensible element 24*a* and the center conductor 43 and as mentioned before, because the base element 36*b* is made of synthetic resin, the base element 36b works as a dielectric material between the extensible element 24a and the center conductor 43. Thus a capacitor is constituted by locating the base element 36b in the gap between the extensible element 24a and the center conductor 43.

The low pass filter 45 is made of a coil 49 and two capacitors 47, 48 as a $\pi$ filter. The capacitance of the capacitor 47 can be reduced or deleted if the electrostatic capacity between the center conductor 43 and the power supply case 30 is sufficient.

VHF and UHF connector 31 is connected to the power supply case 30 by fitting 32. A center conductor 41 of the VHF and UHF connector 31 is connected to the contacting spring 40 and connected to the extensible element 24a electrically. A chip capacitor 50 is placed on the center conductor 41 along the center line of the center conductor 41. The chip capacitor 50 has a chip condenser body and lead terminals at both ends, and is connected in series to the center conductor 41. In this embodiment, the distance between the two lead terminals and the center conductor 41 is about 10 mm.

A flexible wire 46 is connected to the upper extensible element 24i and is free to move inside the base element 36a. The terminal of the flexible wire 46 is connected to a reel 39 driven by a motor 37 so that the extensible elements 24a, . . . 24h, 24i are extended by a rotation of the reel 39. If the length of the extensible elements 24a, . . . , 24i as fully extended by the power of the motor 37 is "L", the extensible elements 24a, . . . , 24i work as a monopole antenna having a length "L".

Figure 3:
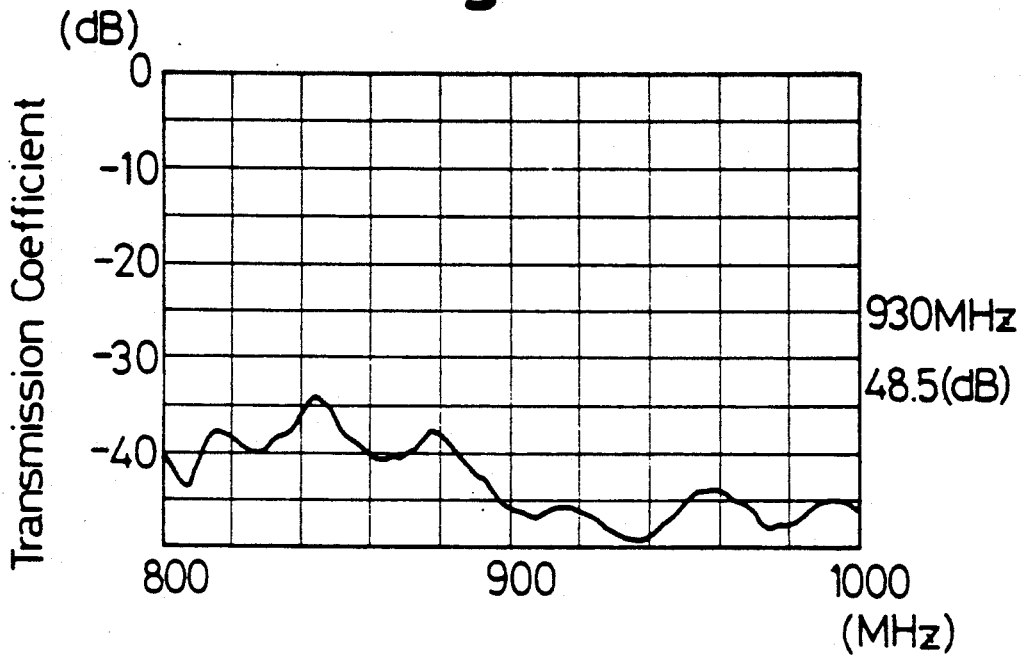
FIG. 3 is a graph showing a relation in a frequency in VHF or UHF band supplied to the supply part of the rod antenna with a leak of electromagnetic waves in AM or FM band to the supply part of the rod antenna.

FIG. 3 shows leakage of the electromagnetic wave at the power supply point for AM/FM when an electromagnetic wave having a frequency between 800 MHz and 1 GHz is supplied to the VHF and UHF connector 31. When the supplied frequency is between 800 MHz and 900 MHz, the attenuation is over 36 dB and when the supplied frequency is between 900 MHz and 1 GHz, the attenuation is over 45 dB. Thus, if the supplied frequency is between 800 MHz and 1 GHz, the power supply point for AM/FM is not saturated by the leakage of higher frequency.

Figure 4:
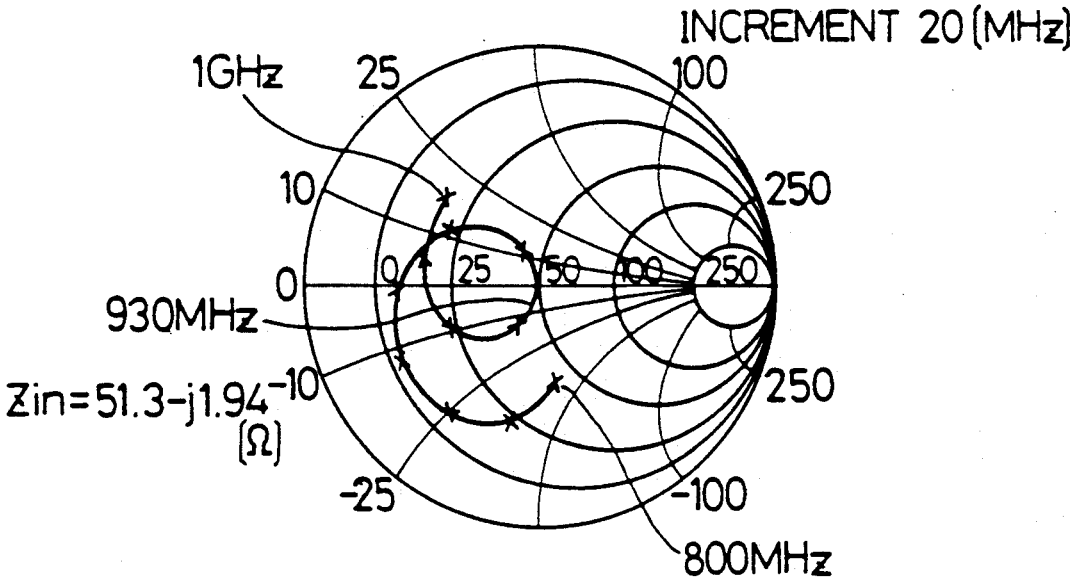
FIG. 4 is a graph showing the impedance at the supply point for a VHF or UHF band signal of a rod antenna of the present invention.

FIG. 4 shows the input impedance when the rod antenna is used as a VHF and UHF antenna if the length of the elements is "L". A range of frequency is between 800 MHz and 1 GHz and if the frequency is between 905 MHz and 955 MHz, SWR (Standing Wave Ratio) is under 2.0 so that the antenna can be used as a transmitting antenna in this frequency band.

Figure 8:
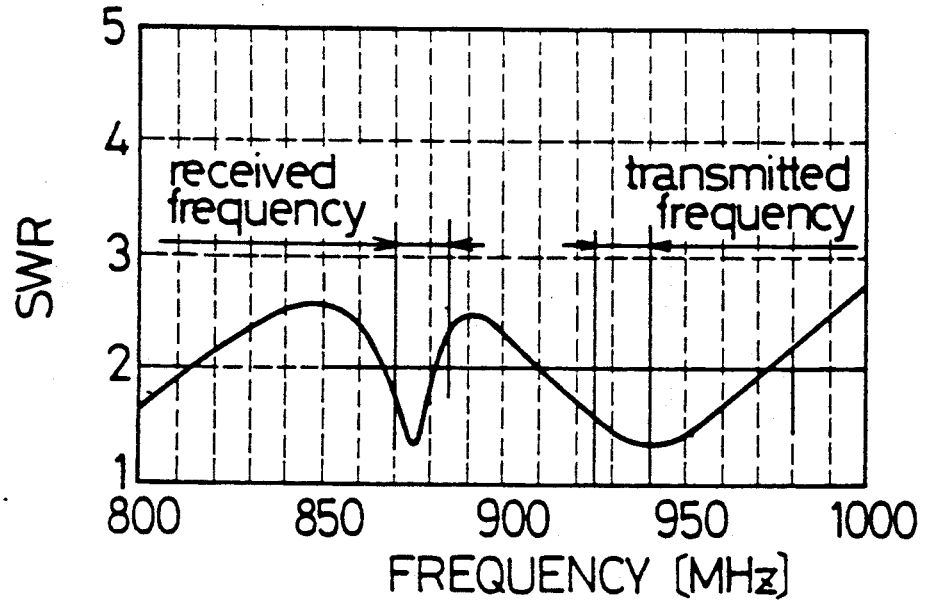
FIG. 8 is a graph showing the SWR characteristics of a rod antenna of the present invention.
Figure 9:
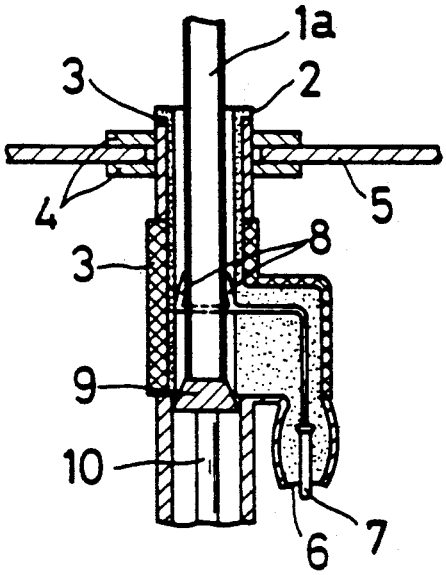
Fig. 9 Prior Art
FIG. 9 is a cross-sectional view of a prior art antenna.
Figure 10:
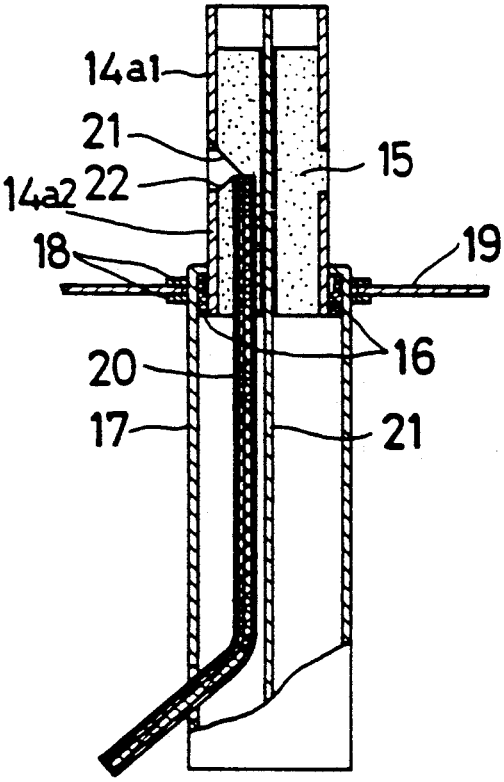
Fig. 10 Prior Art
FIG. 10 is a cross-sectional view of a prior art antenna.

FIG. 8 is a graph showing the SWR characteristics of this embodiment. As shown in FIG. 8, there are two frequency bands in which SWR is under 2, one frequency band is from about 865 MHz to 875 MHz and the other frequency band is from 910 MHz to 976 MHz. In VHF/UHF band, one is for receiving a signal and the other is for transmitting a signal.

In accordance with the above mentioned rod antenna of the present invention, when the extensible elements are extended, the extensible elements are over wrapped or surrounded by the insulating part of the base element i.e., insulating members 26, 27 and 28. Therefore, the electrostatic capacity between the extensible elements and the ground becomes lower. Furthermore, because the extensible elements can be made of the same material, the extensible elements are strengthened. Since the base elements have less restrictions in size, the thickness of the base elements can be thicker than the extensible elements so that the base elements are strengthened as well.

As described above, a rod antenna in accordance with the present invention can be used as a VHF and UHF antenna because the lowest element 24a is surrounded by the synthetic resin base element 36b, but is not surrounded by the metallic base element 36a.

Further, in accordance with the present invention, since the rod antenna has the power supply point for AM/FM band and the power point for VHF/UHF band separate and a low pass filter is provided at the power supply point for AM/FM band, the rod antenna can be used for both frequency bands. In this embodiment, although the power supply point for the AM/FM band and the power supply point for the VHF/UHF band are placed symmetrically as to the extensible elements, the reason for this placement is that it is the easiest positions for design to place the power supply points. In FIGS. 1 and 2, the extensible elements 24a. . . , 24i are not vertical to the body 29 but can be vertical to the body 29 without any influence on the antenna function. A rod antenna in accordance with the present invention can be extended so it is suitable for use as an antenna on an automobile.

In accordance with the present invention, since a capacitor is made by the extensible element 24a, the center conductor 43 and the base element 36b, the electric potential of the extensible element 24a and center conductor 43 is the same when the antenna is used in high frequency bands. Therefore, the center conductor 43 does not affect the VHF/UHF band circuit.

In accordance with the present invention, when a series resonance circuit is placed in series with the elements, the rod antenna has a wider bandwidth. Further, When the resonance circuit of the present invention is not made as a lumped constant circuit, the loss is relatively small.

In this embodiment, the distance between the two lead terminals of the capacitor 50 and the center conductor 41 is about 10 mm. A practical frequency bandwidth depends on the distance. If the distance is longer, the bandwidth is wider. In this embodiment, a chip capacitor is used as the condenser, however, a conventional ceramic condenser may be used.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

What is claimed is:

1. A rod antenna comprising:

a) a plurality of telescoping extensible and retractable elements (24a, . . . 24h, 24i) and b) a base element (36) for storing said extensible and retractable elements upon retraction, wherein said base element is comprised of an upper sleeve (36b) made of insulating material and an elongate, electrically conducting lower sleeve (36a), and wherein a lower portion of a lowermost one of said extensible and retractable elements is disposed above said lower sleeve and is surrounded by said upper sleeve of insulating material when said extensible elements are extended, and wherein the lower portion of said lowermost one (24a) of said extensible and retractable elements is supported by said insulating upper sleeve (36*b*);

a high frequency power supply member electrically connected to said extensible elements;

a low pass filter having one terminal connected to a high pass filter;

a low frequency power supply member connected to another terminal of said low pass filter;

a coaxial cable having a center conductor which connects said low frequency power supply member and said low pass filter, said center conductor forming a part of said low pass filter and extending to the lowermost one of said extensible and retractable elements and being arranged in parallel with the lowermost one of said extensible and retractable elements so as to form said high pass filter;

wherein said low pass filter comprises:

a coil having said one terminal electrically connected to said high pass filter and having said other terminal connected to said low frequency power supply member;

a first capacitor connected between said one terminal of said coil and a ground;

a second capacitor connected between said other terminal of said coil and the ground; and storage means, connected to said ground, for storing said extensible elements, said high frequency power supply member, said low pass filter, said high pass filter and said lower frequency power supply member.

* * * * *

UNITED STATES PATENT AND TRADEMARK OFFICE

CERTIFICATE OF CORRECTION

PATENT NO. : 5,173,712

DATED : December 22, 1992

INVENTOR(S) : Murakami et al

It is certified that error appears in the above-indentified patent and that said Letters Patent is hereby corrected as shown below:

Col. 8, line 15, change "lower" to —low—.

Signed and Sealed this

Fourteenth Day of December, 1993

Bruce Lehman

*Attest:*

BRUCE LEHMAN

*Attesting Officer*

*Commissioner of Patents and Trademarks*